US005165209A

United States Patent [19]

Bischel et al.

[11] Patent Number: 5,165,209

[45] Date of Patent: Nov. 24, 1992

[54] TRANSITION ELEMENT

[75] Inventors: Wesley T. K. Bischel, Elizabethtown; Donald F. Claussen; Martin L. Graver, both of Lancaster; James F. Mathis, Columbia, all of Pa.

[73] Assignee: Armstrong World Industries, Inc., Lancaster, Pa.

[21] Appl. No.: 647,896

[22] Filed: Jan. 30, 1991

[51] Int. Cl.[5] ..... E04B 9/00

[52] U.S. Cl. ..... 52/484; 52/287; 52/288

[58] Field of Search ..... 52/286, 287, 288, 22, 52/273, 608, 609, 220, 484, 486; 174/68.3, 48, 49

[56] References Cited

U.S. PATENT DOCUMENTS

| | | | |
|---|---|---|---|
| D. 128,793 | 8/1941 | Bonnell | D25/119 |
| D. 198,447 | 6/1964 | Lovgren | D25/119 |
| 2,765,886 | 3/1953 | Tedaldi et al. | 52/282 |
| 3,303,620 | 2/1967 | Dawson et al. | 52/275 |
| 3,359,356 | 3/1964 | Mylo | 264/168 |

FOREIGN PATENT DOCUMENTS

| | | | |
|---|---|---|---|
| 0306463 | 3/1989 | European Pat. Off. | 52/484 |

*Primary Examiner*—David A. Scherbel
*Assistant Examiner*—Christopher T. Kent

[57] ABSTRACT

The invention is directed to a transition element for use between an upper ceiling level and a lower ceiling level to form a two-level or multi-level ceiling. The transition element has a configured surface, particularly a curved surface. The transition element is mounted with the top of the curved surface located adjacent the plane of the upper ceiling level and the bottom of the curved surface being located in the plane of the lower ceiling level so that the curved surface forms a transition surface between the two ceiling levels. The transition element is held in position by the ceiling runners used to hold the ceiling boards in position.

5 Claims, 2 Drawing Sheets

TRANSITION ELEMENT

BACKGROUND OF THE INVENTION

1. Field of the Invention

The invention is directed to a special ceiling component which is a transition element between a ceiling system having ceiling boards on two separate levels.

2. Description of the Prior Art

U.S. Pat. Nos. 3,359,356 and 2,765,886 are illustrative of much art generally using extruded or like-shaped plastic elements for diverse construction use such as panel corner beads. U.S. Pat. No. 3,303,620 is typical of art teaching curved or otherwise interfittable configured constructions in various environments.

In the design art, combinations of generally flat flanges with arcuate connections are typified by U.S. Design Pat. Nos. D-128,793 and D-198,447.

None of the prior art structures teach the invention of this application wherein a transition ceiling element is mounted on the runners of a conventional ceiling system. The same runners holding the ceiling boards. The transition element on its lower edge forms a support for some of the lower level ceiling boards.

SUMMARY OF THE INVENTION

The invention is a transition element for use between an upper ceiling level and a lower ceiling level. The transition element has an upper elongated planar element having an upper surface, a lower surface and four edges. At least two kerfs are cut in two opposite edges of the planar element. An elongated configured surface is attached to one edge of the planar element and extends from said edge to an area below the lower surface of the planar element. The configured surface ends in an edge spaced from the planar element and generally below the edge of the planar element opposite from the edge of the planar element where the configured surface is attached.

The transition element is used in a ceiling system whereby the ceiling boards are mounted in position on conventional ceiling runners. Runners in the upper ceiling level are positioned in the kerfs of the planar element and hold the planar element in position. The planar element on its lower edge has a flange which supports some of the lower level ceiling boards. The transition element may be held in place by two runners spaced and parallel to each other or by three runners either spaced and parallel to each other or with two runners spaced and parallel to each other and one runner perpendicular to the parallel runners.

DESCRIPTION OF THE PREFERRED EMBODIMENT

Figure 1:
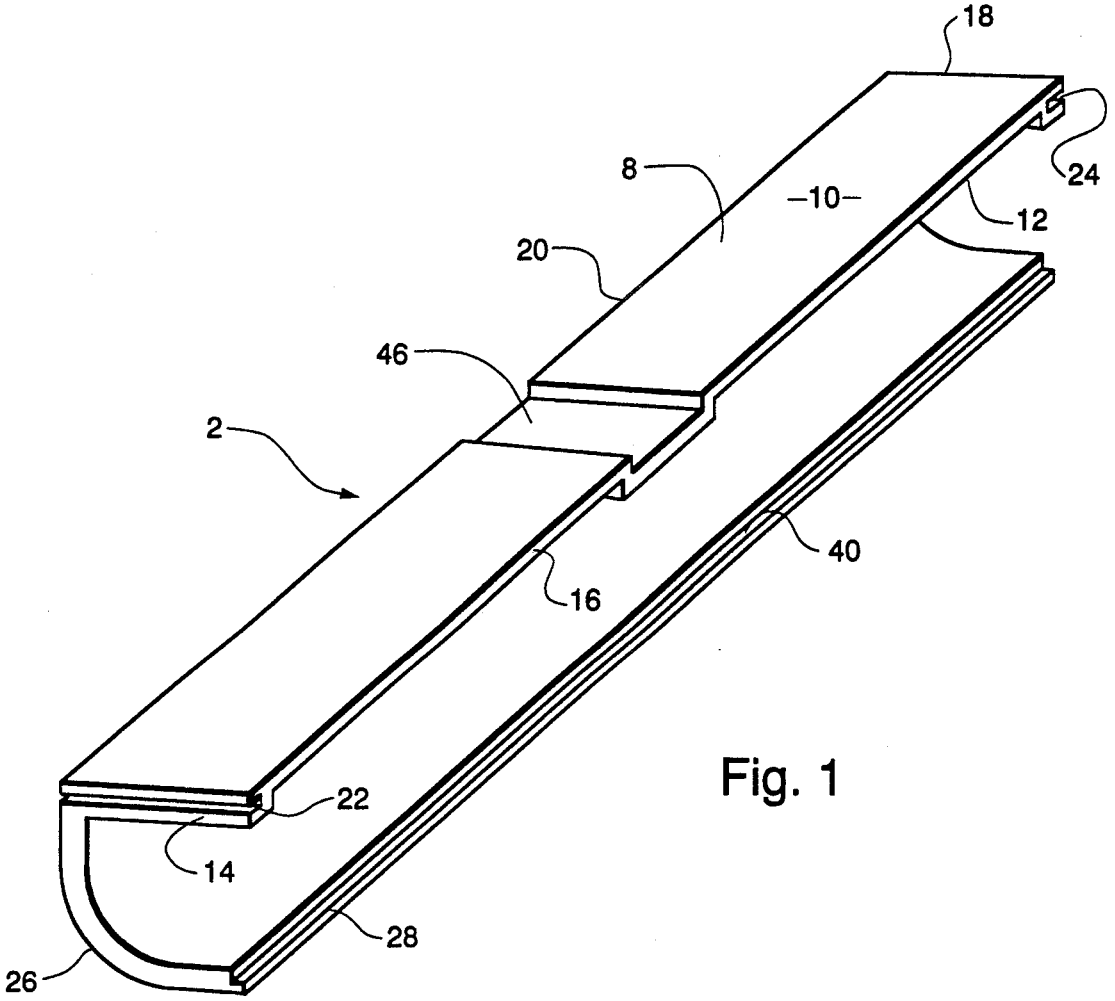
FIG. 1 is a perspective view of the transition element.
Figure 2:
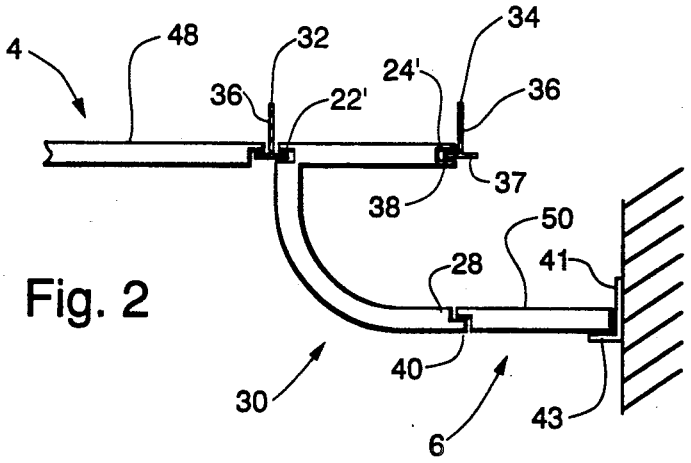
FIG. 2 is an end view of a ceiling system with at least two ceiling and the transition element.

In FIG. 1, the transition element 2 is shown. The transition element functions as a decorative surface between an upper ceiling level 4, as shown in FIG. 2, and a lower ceiling level 6, also shown in FIG. 2. The transition element has an upper elongated planar element 8 which has an upper surface 10, a lower surface 12 and four edges 14, 16, 18 and 20. At least two kerfs or grooves 22 and 24 are cut into the two opposite edges 14 and 18, as shown in FIG. 1. These kerfs or grooves are cut in the short edges of the planar element 8. In FIG. 2, the kerfs 22' and 24' are cut in the elongated edges of the planar surface so that runners 32 and 34 can be mounted in the kerfs on the elongated edges. An elongated configured surface 26 is attached to one edge 20 of the planar element and extends from said edge 20 to below the lower surface 12 of the planar element. This configured surface 26, as shown in FIG. 1, ends in an edge 28 spaced from the planar element 8 and is generally below the edge 16 of the planar element. Edge 16 is on the opposite surface of the planar element 8 from the edge 20. The configured surface could be a curved surface as shown. It could be a step configured surface, a multi-surface design such as is characteristic in wood molding or any other type of configured surface which is attractive to the eye of one designing the surface configuration.

The transition element is used in a ceiling system 30 as shown in FIG. 2. At least two inverted T-shaped runners 32 and 34 each with a vertical web 36 and two opposite flanges 37 and 38 are positioned on the upper part of the transition elements either in kerfs 22 and 24, as shown in FIG. 1, or kerfs 22' and 24' shown in FIG. 2. The runners 32 and 34 are conventional ceiling runners and runner 32, in particular, would be a runner which would normally be positioned in a ceiling system to hold some of the boards in the upper ceiling level. A unique feature of the invention herein is that conventional ceiling runners engaging the top of the transition element hold the transition element in position without any additional support. However, an obvious alternative to the structure shown in FIG. 2 would be to support edge 28 of the transition element by a runner member or even a support wire to position and hold the transition element in position. Such modification would be the full equivalent of the use of runner 34. What is unique about the preferred embodiment shown in FIG. 2 is that the edge 28 of the configured surface has a flange 40 which will function as the support for the ceiling board in the lower ceiling level. As shown in FIG. 2, the wall of the building is shown as element 41 and fastened to the wall of the building is the conventional wall molding 43. This supports one side of the ceiling board 50. The other or left side of the ceiling board is supported on flange 40. Flange 40 is part of the transition element 2 and it is being held rigidly in position by runners 32 and 34. Plural ceiling boards could be used in lieu of board 50. Runner 32 on its right horizontal flange supports the transition element and the horizontal flange on the left of runner 32 supports ceiling board 48 which on its opposite side would be held in position by a conventional runner. Ceiling boards could be mineral fiber ceiling panels, gypsum board, plywood, etc. Thus, it is possible to create a ceiling design for a room wherein the center portion of the ceiling is in a raised position above the portion of the ceiling which engages the wall or vice versa and this creates a two-dimensional vaulted-type ceiling structure which normally is associated with a high cost, highly decorative ceiling.

Figure 3:
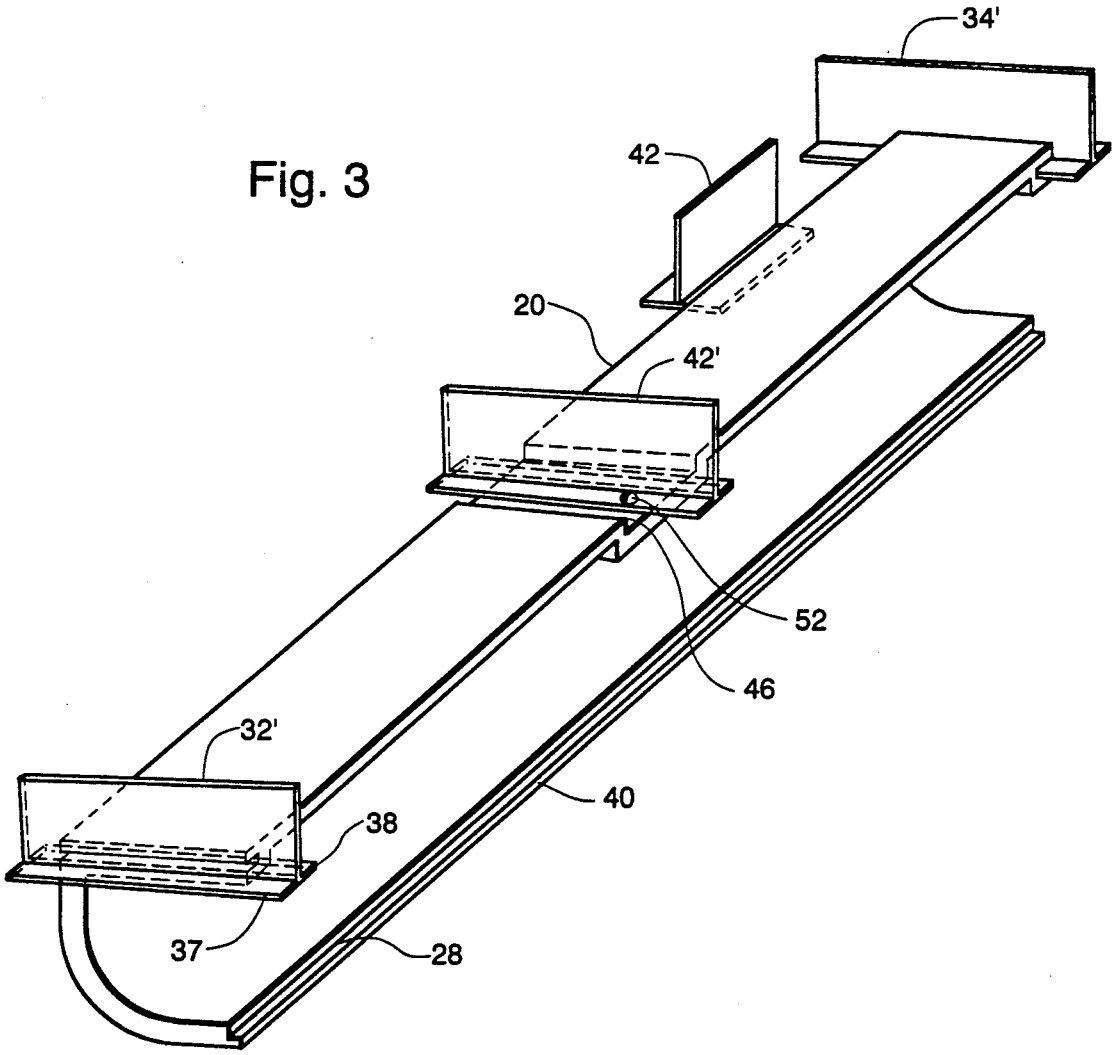
FIG. 3 is a perspective view of the transition element mounted on at least three runners.

As indicated above, two runners could hold the transition element in position by the two runners being positioned on the long side of the planar element 8. Alternately, two runners could be positioned on the short side of the planar element 8. FIG. 3 shows a preferred alternate embodiment wherein a third runner 42' is positioned parallel to runners 32' and 34'. The runners would be on the conventional 24 inch spacing of ceiling runners. The runner 42' would be in a recessed area or cut out area 46 and would be fastened to the transition element by some type of mechanical fastening means such as screw 52. Alternatively, the third runner 42' could be positioned in the kerf of edge 20 and the three runners 32', 42' and 34' could support the transition element in position.

The transition element 2 is preferably made of a molded plaster composition. However, it could be formed from plastic, a fabricated wood structure or other like material depending upon the shape of the configured surface or the individual's choice of material. A plurality of transition elements would be placed side by side in a ceiling. Each transition element would normally be four feet long and a series of elements would be used to span any required area. The edges of the transition elements could simply abut, they could be provided with some type of interlocking arrangement and one could go so far as to place the elements in an abutting relationship and then, particularly with a plaster element, actually tape and use joint compound to conceal the joint of the transition elements.

What is claimed is:

1. A ceiling system comprising:

(a) at least two inverted T-shaped spaced apart runners, each with a vertical web and two opposite flanges on either side of the web;

(b) said runner flanges being located in the same plane and being spaced apart; and (c) a transition element supported on side elements comprising:

(1) an upper elongated planar element having an upper surface and lower surface and four edges;

(2) at least two kerfs cut in two opposite edges;

(3) said spaced runners being positioned with a flange of each runner being placed in one of the two kerfs, whereby the two runner flanges and upper elongated planar element are in the same plane and the transition element is supported solely at the planar element;

(4) an elongated configured surface attached to one long edge of the planar element and extending from said edge to below the lower surface of the planar element;

(5) the configured surface ending in an edge spaced from the planar element and generally below the edge of the planar surface opposite front the edge of the planar element where the configured surface is attached; and (6) said edge of the configured surface below the planar element having a flange located in the lower ceiling level.

2. A ceiling system as set forth in claim 1 wherein:

(a) a third runner in the upper ceiling level is positioned with a flange in a third kerf in the upper elongated planar element.

3. A ceiling system as set forth in claim 1 wherein:

(a) a third runner parallel and between said spaced runners is fastened to a cut out area in the upper elongated planar element.

4. A ceiling system as set forth in claim 1 wherein:

(a) a ceiling board is supported by the same runner supporting the transition element on the runner flange adjacent the planar element and configured surface.

5. A ceiling system as set forth in claim 1 wherein:

(a) a ceiling board is supported on the flange of the edge of the configured surface.

* * * * *